US006378623B2

(12) United States Patent
Kawarai

(10) Patent No.: US 6,378,623 B2
(45) Date of Patent: Apr. 30, 2002

(54) TORQUE CONTROL TYPE IMPACT WRENCH

(75) Inventor: Masaki Kawarai, Shirakawa (JP)

(73) Assignee: Nitto Kohki Co., Ltd., Tokyo (JP)

( * ) Notice: Subject to any disclaimer, the term of this patent is extended or adjusted under 35 U.S.C. 154(b) by 0 days.

(21) Appl. No.: 09/770,972

(22) Filed: Jan. 25, 2001

(30) Foreign Application Priority Data

Jan. 28, 2000 (JP) ..... 2000-019452

(51) Int. Cl.[7] ..... B25B 23/14

(52) U.S. Cl. ..... 173/180; 173/2; 173/176; 173/181

(58) Field of Search ..... 173/180, 181, 173/176, 2; 81/467, 469; 73/761, 862.23, 862.24

(56) References Cited

U.S. PATENT DOCUMENTS

| | | | | |
|---|---|---|---|---|
| 5,062,491 A | * | 11/1991 | Takeshima et al. | 173/181 |
| 5,154,242 A | * | 10/1992 | Soshin et al. | 173/180 |
| 5,315,501 A | * | 5/1994 | Whitehouse | 173/176 |
| 5,366,026 A | | 11/1994 | Maruyama | |
| 5,563,482 A | * | 10/1996 | Shaw et al. | 73/862.23 |
| 5,631,823 A | * | 5/1997 | Layer et al. | 73/862.23 |
| 5,715,894 A | | 2/1998 | Maruyama | |
| 5,937,370 A | * | 8/1999 | Lysaght | 173/180 |

FOREIGN PATENT DOCUMENTS

| | | |
|---|---|---|
| JP | 232117 | 7/1990 |
| JP | 5267368 | 10/1996 |
| JP | 8323639 | 12/1996 |
| JP | 976166 | 3/1997 |
| JP | 2807036 | 9/1998 |
| JP | 1190852 | 4/1999 |
| JP | 2945816 | 9/1999 |

* cited by examiner

*Primary Examiner*—Scott A. Smith
(74) *Attorney, Agent, or Firm*—John P. White; Cooper & Dunham LLP

(57) ABSTRACT

A torque control type impact wrench includes a first storage section for storing an ideal upper limit of the pulsed torque for screwing a male screw into a female screw, as a first storage value, a second storage section for storing a driving speed at which a driving section drives a torque producing section as a second storage value, and a control section for causing the driving section to drive the torque producing section at the second storage value and stopping the driving section when the pulsed torque exceeds the first storage value, wherein the control section causes the second storage section to store a value, which is larger than the second storage value, as a new second storage value when the pulsed torque does not reach the first storage value within a given time period after the driving section starts.

7 Claims, 2 Drawing Sheets

TORQUE CONTROL TYPE IMPACT WRENCH

CROSS-REFERENCE TO RELATED APPLICATIONS

This application is based upon and claims the benefit of priority from the prior Japanese Patent Application No. 2000-019452, filed Jan. 28, 2000, the entire contents of which are incorporated herein by reference.

BACKGROUND OF THE INVENTION

The present invention relates to a torque control type impact wrench for producing torque by its hydraulic mechanism and controlling the produced torque and, more particularly, to a torque control type impact wrench for controlling torque by varying the rotation speed of a motor.

A prior art torque control type impact wrench includes an output shaft, a motor, an oil pulse unit for producing torque, and a torque sensor for sensing the torque. The motor rotates the oil pulse unit to develop oil pressure. The oil pulse unit converts the oil pressure into pulsed torque to rotate the output shaft and apply the torque to the output shaft.

A controller is electrically connected to the torque control type impact wrench to control the operation of the impact wrench. Before a fastening operation, the controller is supplied with criteria setting conditions suitable for male and female screws, i.e., the rotation speed of the motor and a cutoff torque value. The controller rotates the motor at the rotation speed and stops it when the produced torque exceeds the cutoff torque value.

The male and female screws are classified into three types of soft, rigid and intermediate parts according to a fastening characteristic or a relationship between a fastening torque and a fastening angle. The criteria setting conditions are determined with reference to the intermediate part. When an operator fastens the male and female screws of soft or rigid parts together, he or she controls and sets the conditions by experience and inputs them to the controller.

According to the prior art torque control type impact wrench described above, when the soft or rigid male and female screws, which differ from the intermediate screw in fastening characteristics, are fastened to each other, there are cases where the rotation speed of the motor is too low to produce an adequate torque because of inappropriate conditions input to the controller, and the screws are fastened insufficiently or excessively because of an improper cutoff torque value.

Furthermore, when an operator screws a plurality of male screws of the same specifications into their different fastening portions of female screws, he or she often fastens them under the same fastening conditions, though the fastening characteristics vary from fastening portion to fastening portion. Thus, the operator cannot fasten the screws appropriately.

BRIEF SUMMARY OF THE INVENTION

It is accordingly an object of the present invention to provide a torque control type impact wrench that is capable of performing an appropriate fastening operation irrespective of the fastening characteristics and fastening portions of male and female screws.

In order to attain the above object, a torque control type impact wrench according to a first aspect of the present invention comprises torque producing means for producing pulsed torque, driving means for driving the torque producing means, a rotating shaft fitted to a predetermined male screw and rotated by the pulsed torque produced from the torque producing means, for screwing the male screw into a predetermined female screw, first setting means for setting an ideal upper limit of the pulsed torque for screwing the male screw into the female screw, second setting means for setting a driving speed at which the driving means drives the torque producing means, first storage means for storing the ideal upper limit of the pulsed torque, which is set by the first setting means, as a first storage value, second storage means for storing the driving speed, which is set by the second setting means, as a second storage value, and control means for causing the driving means to drive the torque producing means at the second storage value and stopping the driving means when the pulsed torque exceeds the first storage value, wherein the control means causes the second storage means to store a value, which is larger than the second storage value, as a new second storage value when the pulsed torque does not reach the first storage value within a given time period after the driving means starts.

The control means of the torque control type impact wrench so constituted allows the driving means to stop when the torque exceeds the ideal upper limit. The upper limit of the torque produced from the torque producing means can be considered to be an ideal upper limit of the torque for screwing the male screw into the female screw.

When the torque producing means cannot produce any fastening torque, which is not lower than the ideal upper limit, within a given time period after the driving means starts, the control means allows the second storage means to store a higher new speed in place of the driving speed stored in the second storage means, and causes the driving means to drive the torque producing means at such a higher driving speed that the torque producing means can produce torque that is not lower than the ideal upper limit. If the driving means drives the torque producing means at a higher driving speed, the torque producing means produces a higher torque, so that it can produce a fastening torque, which is not lower than the ideal upper limit, within a given time period after the driving starts. Typically, the control means increases the second storage value immediately after the driving means stops.

When the torque producing means cannot produce any fastening torque, which is not lower than the ideal upper limit, within a given time period after the driving means starts even though the driving means drives the torque producing means at the higher new speed, the control means can cause the second storage means to store a much higher new speed in place of the driving speed stored in the second storage means. This process can be repeated until the torque producing means produces a fastening torque, which is not lower than the ideal upper limit, within a given time period after the driving means starts. Typically, the driving means, the driving, and the driving speed correspond to rotating means, rotation, and rotation speed (number of rotations), respectively.

In the torque control type impact wrench according to the first aspect of the present invention, the impact wrench according to a second aspect of the present invention further comprises torque measuring means for measuring the torque, and the control means causes the second storage means to store a value, which is smaller than the second storage value, as a new second storage value when a maximum value of the torque measured by the torque measuring means exceeds the ideal upper limit by a given value or more.

The above torque measuring means so constituted measures the torque produced by the torque producing means and an excess amount of the torque that exceeds the ideal upper limit after the control means starts to stop the driving means. If the excess amount is larger than a predetermined tolerable value, the control means lowers the driving speed (second storage value) of the driving means and replaces it with a smaller new value to cause the excess amount to fall within a given range. Typically, the control means decreases the second storage value immediately after the driving means stops.

In the torque control type impact wrench according to the first aspect of the present invention, the impact wrench according to a third aspect of the present invention further comprises torque measuring means for measuring the torque, and the control means causes the first storage means to store a value, which is smaller than the first storage value, as a new first storage value when a maximum value of the torque measured by the torque measuring means exceeds the ideal upper limit by a given value or more.

The above torque measuring means so constituted measures the torque produced by the torque producing means and an excess amount of the torque that exceeds the ideal upper limit after the control means starts to stop the driving means. If the excess amount is larger than a predetermined tolerable value, the control means lowers a torque value (first storage value) for starting to stop the driving means, and replaces it with a smaller new value to cause the excess amount to fall within a given range. Typically, the control means decreases the first storage value immediately after the driving means stops.

When the above excess amount does not fall within a given tolerable range even though the driving means is stopped at the smaller new torque value, the control means can cause the first storage means to store a much smaller new value in place of the torque value stored in the first storage means. This process can be repeated until the excess amount falls within the given tolerable range.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

An embodiment of the present invention will now be described with reference to the accompanying drawings.

Figure 1:
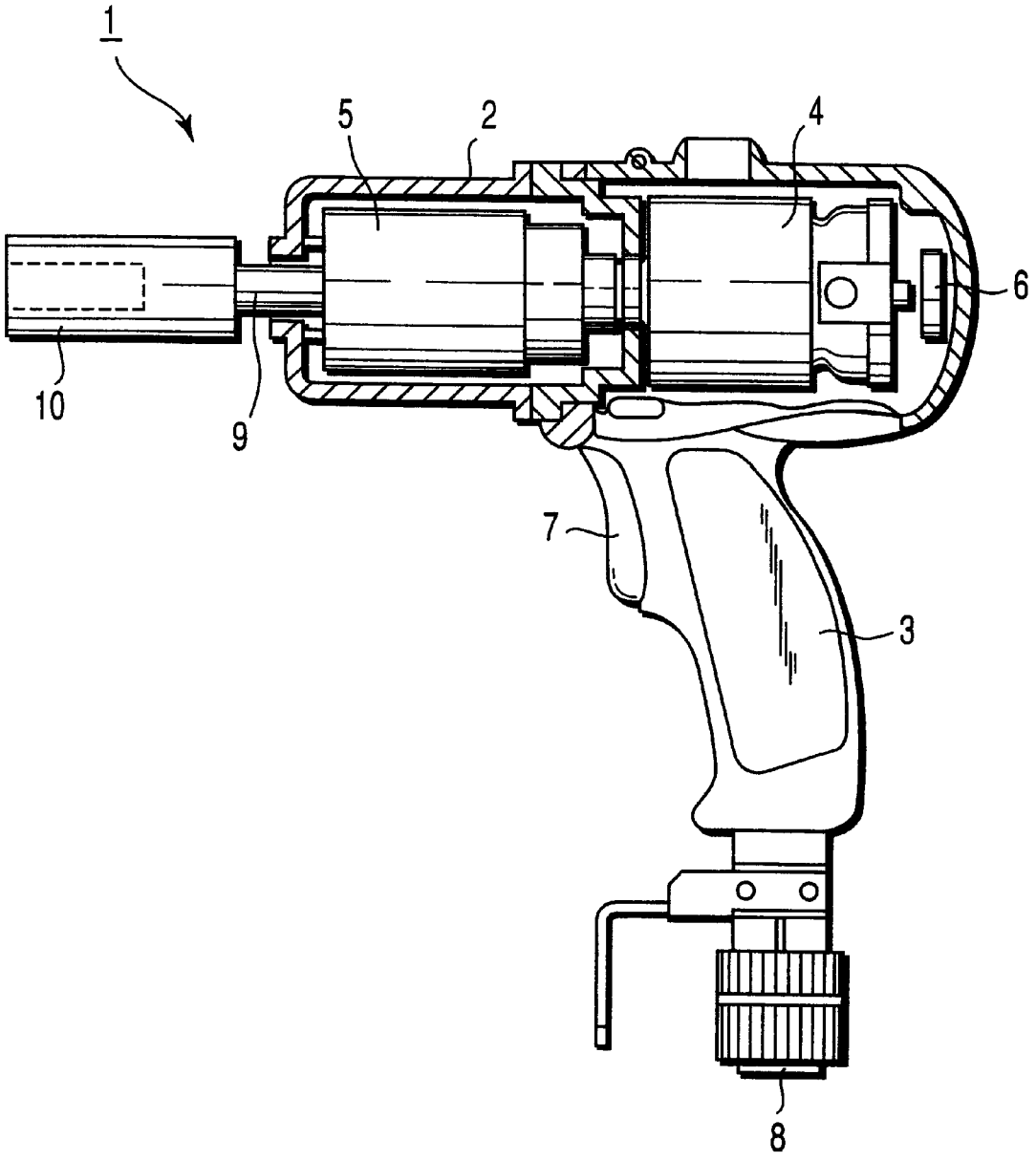
FIG. 1 is a partly sectional view schematically showing the structure of a torque control type impact wrench according to an embodiment of the present invention.

FIG. 1 is a partly sectional view of a torque control type impact wrench 1 according to the present invention. The impact wrench 1 comprises a case 2 and a grip 3. The case 2 includes an electric motor 4 serving as a driving means and an oil pulse unit 5 serving as a torque producing means.

The electric motor 4 rotates the oil pulse unit 5 to develop oil pressure P. This oil pressure P produces pulsed torque T. The case 2 also includes an oil pressure sensor 6 for sensing the developed oil pressure P. If the oil pressure P fluctuates, then the torque T does too. The sensing of the oil pressure P therefore corresponds to that of the torque T. The oil pressure sensor 6 can thus function as a torque sensor 6 for sensing torque. However, the torque sensor 6 senses a value corresponding to the pulse height of the torque T. The electric motor 4 is a DC motor.

The grip 3 is constituted of a magnesium frame in order to save weight. The grip 3 has a trigger switch 7 and a connector 8 at the bottom. When an operator depresses the trigger switch 7, the electric motor 4 starts. The connector 8 with a cable (not shown) is connected to a controller 11 (shown in FIG. 2). The torque T produced from the oil pulse unit 5 can be obtained by rotation of an output shaft 9 that protrudes from the case 2 and serves as a rotation axis of the impact wrench of the present invention. A socket 10 is coupled to the output shaft 9.

Figure 2:
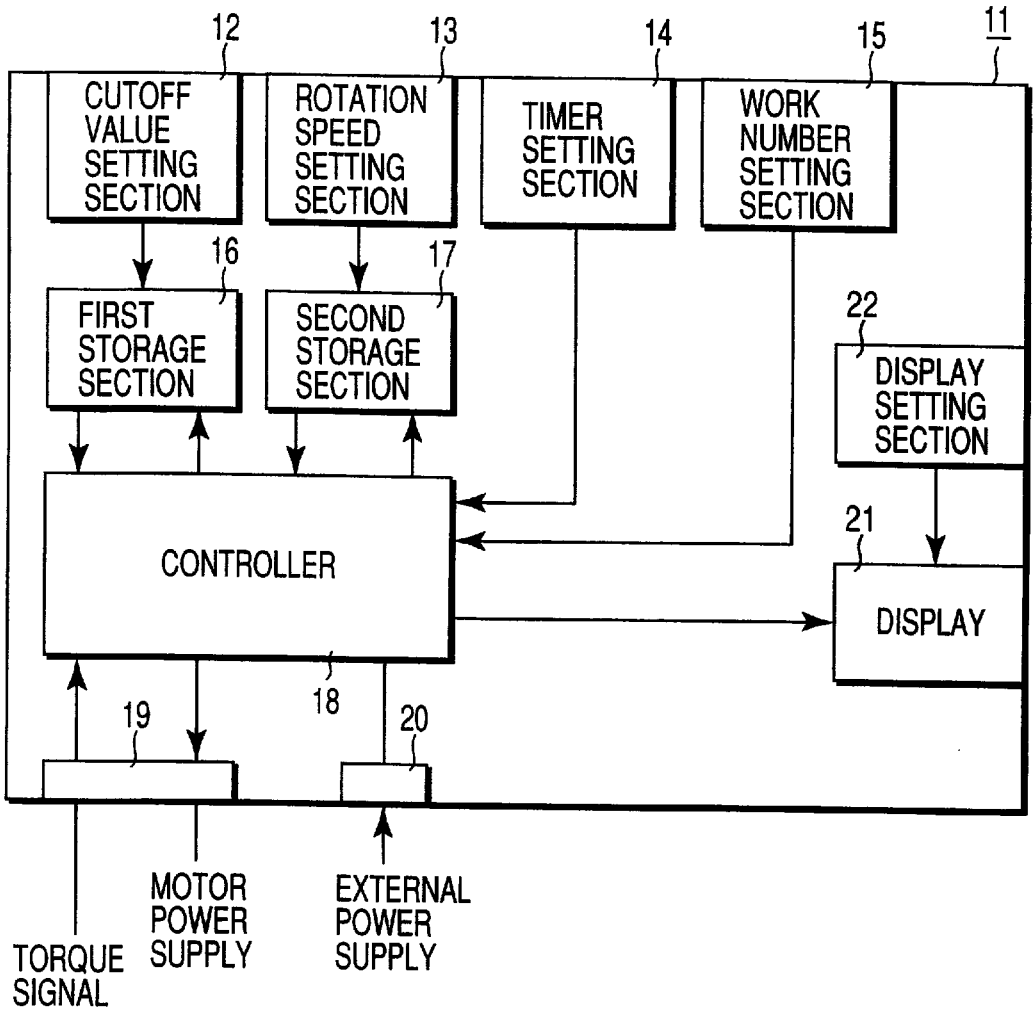
FIG. 2 is a block diagram of the structure of a controller of the torque control type impact wrench shown in FIG. 1

FIG. 2 is a schematic block diagram showing a structure of the controller 11 of the torque control type impact wrench 1 illustrated in FIG. 1. The controller 11 comprises a torque cutoff value setting section 12 serving as a first setting means, a rotation speed setting section 13 used as a second setting means, a timer setting section 14, a workpiece number setting section 15, a first storage section 16 serving as a first storage means, a second storage section 17 serving as a second storage means, a control section 18 used as a control means, a connector 19, a power supply connector 20, a display section 21, and a display setting section 22.

The rotation speed setting section 13 sets rotation speed N as a driving speed of the impact wrench of the present invention that is suitable for workpieces by experience. Usually, first, the section 13 can set a rotation speed N suitable for an intermediate workpiece, and then a lower rotation speed N for a rigid workpiece and a higher rotation speed N for a soft workpiece. The soft workpiece is an object whose rigidity is low. The rigid workpiece is an object whose rigidity is high. The intermediate workpiece is an object whose rigidity lies between the rigid and soft workpieces.

A cutoff torque value $T_C$ of torque T, which is set by the cutoff value setting section 12, is defined as the ideal upper limit torque $T_{UL}$ of a workpiece. The first storage section 16 stores the cutoff torque value $T_C$ set by the cutoff value setting section 12. If the torque T does not reach the cutoff torque value $T_C$ within a given time period t after the electric motor 4 starts, the motor 4 stops. The timer setting section 14 sets this time period t.

The second storage section 17 stores the rotation speed N of the workpiece that is set by the rotation speed setting section 13. The workpiece number setting section 15 sets a workpiece number n so as to distinguish workpieces from one another and distinguish portions in which the workpieces are to be fastened. The control section 18 applies a motor power supply voltage to the electric motor 4 and controls the voltage such that the electric motor 4 can stop when the motor 4 rotates at the rotation speed N stored in the second storage section 17 and the torque T reaches the cutoff torque value $T_C$ stored in the first storage section 16.

The controller 11 stores the above-set workpiece number n, time t, first storage value (cutoff torque value $T_C$), and second storage value (rotation speed N) in association with one another. If an operator designates the workpiece number n before a fastening operation, he or she can perform the operation under the conditions stored in association with one another.

The connector 19 has a cable (not shown) for connecting the torque control type impact wrench 1 (shown in FIG. 1) and the controller 11 together. The torque sensor 6 supplies a torque signal to the control section 18 through the cable. The control unit 18 applies the motor power supply voltage to the electric motor 4. The power supply connector 20 applies an external power supply voltage to the controller 11.

The display section 21 of the controller 11 displays the first storage value (cutoff torque value) $T_C$, second storage value (rotation speed) N, timer setting value t, work number n, and the like, by varying display settings by the display setting section 22.

An operation of the torque control type impact wrench 1 of the present invention will now be described with reference to FIGS. 1 and 2.

The socket 10 is connected to the output shaft 9 of the case 2. The connector 8 of the impact wrench 1 and the connector 19 of the controller 11 are connected to each other by means of the cable. An external power supply is connected to the power supply connector 20 of the controller 11. In order to distinguish a given workpiece (male and female screws) to be subjected to a fastening operation, a work number n assigned to the workpiece is input to the workpiece number setting section 15.

When an operator performs a fastening operation of a given workpiece for the first time, he or she inputs rotation speed N suitable for the workpiece to the rotation speed setting section 13 and supplies the upper limit torque $T_{UL}$ suitable for the workpiece to the cutoff value setting section 12. Both the rotation speed N and the upper limit torque $T_{UL}$ are criteria setting conditions for the workpiece. At this time, the upper limit torque $T_{UL}$ is equal to the cutoff torque value $T_C$. Even if the same workpieces vary in fastening portions and in upper limit torque $T_{UL}$, different workpiece numbers n are assigned to the workpieces. A limit is set to time t from when the electric motor 4 starts until when the torque T reaches the cutoff torque value $T_C$. This time limit t is input to the timer setting section 14.

The operator holds the grip 3 and fits the tip of the socket 10 to a male screw (not shown). He or she then pulls the trigger switch 7 to rotate the electric motor 4. The rotation of the motor 4 causes the oil pulse unit 5 to develop oil pressure P. The oil pressure P produces pulsed torque T and rotates the socket 10. As the socket 10 rotates, the male screw is screwed into the female screw (not shown).

The torque sensor 6 senses the torque T and supplies a torque signal to the control section 18. If the torque T exceeds the cutoff torque value $T_C$ when the electric motor 4 rotates at the set rotation speed N, the control section 18 stops the rotation of the electric motor 4. Because of a time delay in the rotation stop control, the torque T sensed by the torque sensor 6 decreases after it reaches the maximum torque value Tmax that is larger than the cutoff torque value $T_C$.

If the torque T does not reach the cutoff torque value $T_C$ within the time limit t, the control section 18 stops the electric motor 4 and causes the second storage section 17 to store a rotation speed N in place of the rotation speed N that has been stored in the second storage section 17. If then the electric motor 4 rotates to restart the fastening operation, the control section 18 rotates the motor 4 at the rotation speed N.

Since the rotation speed N set by the rotation speed setting section 13 and stored in the second storage section 17 is suitable for, e.g., an intermediate workpiece, it may be too low for a soft workpiece under fastening operation and the fastening torque T may not exceed the upper limit torque $T_{UL}$ within the time limit t. In this case, the control section 18 completes the fastening operation and immediately afterward it automatically raises the rotation speed N stored in the second storage section 17. Therefore, the fastening torque T is usually allowed to exceed the upper limit torque $T_{UL}$ within the time limit t in the next fastening operation.

If the fastening torque T does not exceed the upper limit torque $T_{UL}$ even in the next fastening operation, the control section 18 completes the fastening operation and immediately afterward it automatically raises the rotation speed N stored in the second storage section 17 further. If the fastening operation is repeated until the fastening torque T exceeds the upper limit torque $T_{UL}$ within the time limit t, the rotation speed N stored in the second storage section 17 comes to have a new appropriate value. Thus, the operator need not change the set rotation speed N manually but can perform an appropriate fastening operation with efficiency.

Even though the fastening torque T is allowed to exceed the upper limit torque $T_{UL}$ within the time limit t, if a difference between the maximum torque value Tmax and the cutoff torque value $T_C$ is not smaller than a given value, an excessive fastening torque will act on a workpiece. The control section 18 thus causes the second storage section 17 to store a new rotation speed N, which is lower than the rotation speed N stored in the section 17, in place of the latter rotation speed N. In this case, the electric motor 4 rotates to restart the fastening operation after the new rotation speed N is stored in the second storage section 17. The control section 18 thus determines the new rotation speed N in order that the maximum torque value Tmax measured after the fastening operation is restarted may become equal to the upper limit torque $T_{UL}$.

Since the rotation speed N set by the rotation speed setting section 13 is suitable for, e.g., an intermediate workpiece, it may be too high for a rigid workpiece under fastening operation and a difference between the maximum torque value Tmax and the cutoff torque value $T_C$ may not be smaller than a given value. In this case, the control section 18 completes the fastening operation and immediately afterward it lowers the rotation speed N automatically. In the next fastening operation, therefore, the above difference is allowed to fall within a predetermined range. If the difference is not smaller than a given value even in the next fastening operation, the control section 18 completes the operation and immediately afterward it automatically lowers the rotation speed N further. If the fastening operation has only to be repeated until the difference falls within the predetermined range. The operator need not change the set rotation speed manually but can perform an appropriate fastening operation with efficiency.

The range of an increase in rotation speed N when the torque T does not reach the cutoff torque value $T_C$ within the time limit t and that of a decrease in rotation speed N when a difference between the maximum torque value Tmax and the cutoff torque value $T_C$ becomes not smaller than a given value, can be varied to make the latter range smaller than the former range.

When a difference between the measured maximum torque value Tmax and the set cutoff torque value $T_C$ is not smaller than a predetermined value, the control section 18 can cause the first storage section 16 to store a smaller new cutoff torque value $T_C$ in place of the cutoff torque value $T_C$ stored in the section 16. After that, the electric motor 4 rotates to restart the fastening operation. Then, the control section 18 determines the cutoff torque value $T_C$ in order that the maximum torque value Tmax measured after the fastening operation is restarted may become equal to the upper limit torque $T_{UL}$.

When a plurality of workpieces of the same material and of the same size are fastened to different fastening portions, the rotation speed N set by the rotation speed setting section 13 is suitable for a first workpiece but may be too high for a second workpiece and too low for a third workpiece due to a difference in fastening portions. If, in this case, the second and third workpieces are each fastened two or more times, the fastening operation can be performed efficiently because the control section 18 automatically sets and stores an appropriate rotation speed for each of the fastening portions. A temporary fastening operation can be done in order to store a rotation speed suitable for each of the fastening portions.

According to the present invention described above, the control means causes the second storage means to store a value, which is larger than the second storage value, as a new second storage value when the torque produced from the torque producing means does not reach the first storage value within a given time period after the driving means starts. Thus, the driving means can be operated but not by hand at an appropriate driving speed, and the torque can be set so as to reach the first storage value within a given time period after the driving means starts. Consequently, an adequate fastening torque can be produced irrespective of fastening characteristics and fastening portions of female screws; therefore, a fastening operation can be performed with efficiency.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A torque control type impact wrench comprising:

torque producing means for producing pulsed torque;

driving means for driving the torque producing means;

a rotating shaft fitted to a predetermined male screw and rotated by the pulsed torque produced from the torque producing means, for screwing the male screw into a predetermined female screw;

first setting means for setting an ideal upper limit of the pulsed torque for screwing the male screw into the female screw;

second setting means for setting a driving speed at which the driving means drives the torque producing means;

first storage means for storing the ideal upper limit of the pulsed torque, which is set by the first setting means, as a first storage value;

second storage means for storing the driving speed, which is set by the second setting means, as a second storage value; and control means for causing the driving means to drive the torque producing means at the second storage value and stopping the driving means when the pulsed torque exceeds the first storage value, wherein the control means causes the second storage means to store a value, which is larger than the second storage value, as a new second storage value when the pulsed torque does not reach the first storage value within a given time period after the driving means starts.

2. The torque control type impact wrench according to claim 1, wherein the torque control type impact wrench further comprises torque measuring means for measuring the torque, and the control means causes the second storage means to store a value, which is smaller than the second storage value, as a new second storage value when a maximum value of the torque measured by the torque measuring means exceeds the ideal upper limit by a given value or more.

3. The torque control type impact wrench according to claim 1, wherein the torque control type impact wrench further comprises torque measuring means for measuring the torque, and the control means causes the first storage means to store a value, which is smaller than the first storage value, as a new first storage value when a maximum value of the torque measured by the torque measuring means exceeds the ideal upper limit by a given value or more.

4. The torque control type impact wrench according to claim 1, further comprising third setting means for setting a workpiece number in order to distinguish workpieces from one another and distinguish portions in which the workpieces are to be fastened.

5. The torque control type impact wrench according to claim 4, wherein the control means operates to store the first storage value, the second storage value, the workpiece number, and the given time period in association with one another, thereby performing a fastening operation for the workpieces under conditions stored in association with one another if the workpiece number is designated before the fastening operation.

6. The torque control type impact wrench according to claim 4, wherein when a plurality of workpieces of same material and same size are fastened together, if the workpieces vary in fastening portion and in ideal upper limit of pulsed torque, different workpiece numbers are assigned to the workpieces even though the workpieces have same material and same size.

7. The torque control type impact wrench according to claim 1, wherein the driving means includes an electric motor and, when a plurality of workpieces of same material and same size are fastened to different fastening portions, the control means sets and stores a rotation speed of the electric motor suitable for each of the fastening portions.

* * * * *